US010048014B2

(12) United States Patent
Bader et al.

(10) Patent No.: US 10,048,014 B2
(45) Date of Patent: Aug. 14, 2018

(54) PLATE HEAT EXCHANGER WITH IMPROVED STRENGTH IN PORT AREA

(71) Applicant: ALFA LAVAL CORPORATE AB, Lund (SE)

(72) Inventors: Roger Bader, Hisings Backa (SE); Lars Einar Gustavsson, Kallinge (SE); Jerry Hökevik, Ronneby (SE)

(73) Assignee: ALFA LAVAL CORPORATE AB, Lund (SE)

( * ) Notice: Subject to any disclaimer, the term of this patent is extended or adjusted under 35 U.S.C. 154(b) by 456 days.

(21) Appl. No.: 14/372,497

(22) PCT Filed: Feb. 6, 2013

(86) PCT No.: PCT/SE2013/050098
§ 371 (c)(1),
(2) Date: Jul. 16, 2014

(87) PCT Pub. No.: WO2013/122529
PCT Pub. Date: Aug. 22, 2013

(65) Prior Publication Data

US 2015/0007970 A1 Jan. 8, 2015

(30) Foreign Application Priority Data

Feb. 14, 2012 (SE) ..... 1250120

(51) Int. Cl.
*F28F 3/00* (2006.01)
*F28F 3/08* (2006.01)
*F28D 9/00* (2006.01)

(52) U.S. Cl.
CPC ..... *F28D 9/0062* (2013.01); *F28D 9/005* (2013.01); *F28F 3/00* (2013.01); *F28F 3/08* (2013.01); *F28F 2225/00* (2013.01)

(58) Field of Classification Search
CPC .... F28F 3/036; F28F 3/08; F28F 3/083; F28F 3/086; F28F 3/10; F28F 3/005; F28F 9/0075; F28F 9/005
See application file for complete search history.

(56) References Cited

U.S. PATENT DOCUMENTS 4,330,077 A 5/1982 Young
4,872,578 A 10/1989 Fuerschbach et al.
(Continued)

FOREIGN PATENT DOCUMENTS

CN 1292862 A 4/2001
CN 101162132 A 4/2008
(Continued)

OTHER PUBLICATIONS

International Search Report (PCT/ISA/210) dated Jun. 19, 2013, by the Europea Patent Office as the International Searching Authority for International Application No. PCT/SE2012/050098.
(Continued)

*Primary Examiner* — Jason Thompson
(74) *Attorney, Agent, or Firm* — Buchanan Ingersoll & Rooney PC

(57) ABSTRACT

A plate heat exchanger comprises plural heat exchanger plates and at least one adapter plate, which each extend parallel with a main extension plane. The heat exchanger plates form a plate package with first and second plate interspaces for first and second mediums. Each heat exchanger plate has four port holes extending through the plate package. The heat exchanger plates comprise outermost heat exchanger plates. Two of the plate interspaces form a respective outermost plate interspace at a respective side of the plate package, which are delimited outwardly by a respective one of the outermost heat exchanger plates, and the adapter plate is outside one of the outermost heat exchanger plates. A distance plate between the adapter plate
(Continued)

and one of the outermost heat exchanger plates has at least two port holes concentric with each of the respective port holes of the outermost heat exchanger plates and the adapter plate.

10 Claims, 3 Drawing Sheets

(56) References Cited

U.S. PATENT DOCUMENTS

| | | | | |
|---|---|---|---|---|
| 4,987,955 | A | 1/1991 | Bergqvist et al. | |
| 5,184,673 | A | 2/1993 | Hedman et al. | |
| 5,358,034 | A | 10/1994 | Nishishita et al. | |
| 5,971,065 | A * | 10/1999 | Bertilson | F28F 9/026 165/153 |
| 5,988,269 | A * | 11/1999 | Karlsson | F28D 9/005 165/167 |
| 6,394,179 | B1 * | 5/2002 | Blomgren | F28D 9/005 165/166 |
| 7,717,164 | B2 | 5/2010 | Richter | |
| 8,596,343 | B2 | 12/2013 | Christensen et al. | |
| 2003/0051865 | A1 | 3/2003 | Stromer et al. | |
| 2003/0201094 | A1 * | 10/2003 | Evans | F28D 9/005 165/109.1 |
| 2004/0211550 | A1 * | 10/2004 | Finch | F28F 3/083 165/167 |
| 2007/0289724 | A1 * | 12/2007 | Hoof | F28D 9/005 165/149 |
| 2008/0190595 | A1 * | 8/2008 | Sjodin | B23K 1/0012 165/167 |
| 2008/0216987 | A1 * | 9/2008 | Thumm | F28D 9/005 165/67 |
| 2008/0236802 | A1 | 10/2008 | Koepke et al. | |
| 2009/0008072 | A1 * | 1/2009 | Rassmus | F28D 9/005 165/167 |
| 2009/0032231 | A1 * | 2/2009 | Komoda | F28D 9/005 165/166 |
| 2010/0006275 | A1 | 1/2010 | Arvidsson | |
| 2010/0243200 | A1 * | 9/2010 | Baker, Jr. | B60H 1/00342 165/41 |

FOREIGN PATENT DOCUMENTS

| | | | |
|---|---|---|---|
| CN | 101184574 | A | 5/2008 |
| CN | 101512252 | A | 8/2009 |
| CN | 101983310 | A | 3/2011 |
| DE | 4314808 | A1 | 11/1994 |
| DE | 19628560 | C1 | 8/1997 |
| DE | 102006048305 | A1 | 4/2008 |
| EP | 0347961 | A1 | 12/1989 |
| EP | 1052468 | A2 | 11/2000 |
| EP | 1855074 | A2 | 11/2007 |
| JP | 01-503558 | A | 11/1989 |
| JP | 08-042992 | A | 2/1996 |
| JP | 11-101590 | A | 4/1999 |
| JP | 2000266479 | A | 9/2000 |
| JP | 2005524042 | A | 8/2005 |
| JP | 2008-542029 | A | 11/2008 |
| JP | 2010002123 | A | 7/2010 |
| WO | 88/09473 | A1 | 12/1988 |
| WO | WO 94/14021 | A1 | 6/1994 |
| WO | WO 97/15798 | A1 | 5/1997 |
| WO | 99/46549 | A1 | 9/1999 |
| WO | 03/091647 | A1 | 11/2003 |
| WO | 2006/126931 | A1 | 11/2006 |
| WO | WO 2007/114779 | A1 | 10/2007 |
| WO | 2008/024066 | A1 | 2/2008 |

OTHER PUBLICATIONS

Written Opinion (PCT/ISA/237) dated Jun. 19, 2013, by the European Patent Office as the International Searching Authority for International Application No. PCT/SE2012/050098.

Swedish Search Report dated Aug. 30, 2012 for Swedish Application No. ITS/SE12/00025.

English language version of Office Action (Notice of Reasons for Rejection) dated Jun. 22, 2015, by the Japanese Patent Office in corresponding Japanese Patent Application No. 2014-556515 (3 pages).

Office Action (First) and Search Report dated Oct. 27, 2015, by the State Intellectual Property Office of the People's Republic of China in corresponding Chinese Patent Application No. 201380009339.1 (9 pgs).

Office Action (Notice of Reasons for Rejection) dated Apr. 4, 2016, by the Japanese Patent Office in corresponding Japanese Patent Application No. 2014-556515 in English.

English language translation of Office Action dated Dec. 8, 2015, by the Taiwanese Patent Office in the corresponding Taiwanese Patent Application No. 102104341. (6 pages).

* cited by examiner

PLATE HEAT EXCHANGER WITH IMPROVED STRENGTH IN PORT AREA

BACKGROUND OF THE INVENTION

The present invention relates to a plate heat exchanger comprising a plate package of permanently joined heat transfer plates, between which passages for at least two heat exchange fluids are formed. Each heat transfer plate is provided with port holes, which together with corresponding port holes in the other heat transfer plates form port channels through the plate package.

The heat transfer plates in a plate heat exchanger of this kind are usually permanently joined with each other through welding, brazing or bonding. In a plate heat exchanger where the heat transfer plates have been permanently joined with each other through brazing the heat exchanger often is provided with two end plates, which are thicker than the heat transfer plates and are permanently joined together with the two respective outer heat transfer plates in the plate package. Usually, one of the end plates is provided with holes opposite to the port channels through the plate package, but also the other end plate can be provided with one or more holes opposite to the port channels. Onto at least one of the end plates connection members, usually in the form of pipe sockets, are fastened e.g. by brazing around the respective holes of these plates. Each one of the end plates does not have to be made in one piece but can be made of two or more parts.

The passages for heat exchange fluids between the heat transfer plates are normally connected to the port channels in a way such that every second passage will be flowed through by one of the heat exchange fluids and, accordingly, is included in a first set of passages. The remaining passages form a second set of passages, which will be flowed through by the other heat exchange fluid. When the plate heat exchanger is in operation the first heat exchange fluid flows through a first pipe socket into a first port channel, further through the first set of passages to a second port channel and out through a second pipe socket. The second heat exchange fluid flows through a third pipe socket into a third port channel, further through the second set of passages to a fourth port channel and out through a fourth pipe socket.

In many applications for permanently joined, e g brazed, plate heat exchangers, a high strength is required in order to cope with high working pressures of one or more of the media conveyed through the plate heat exchanger or when the working pressure for any of the media varies over time. To ensure that the strength and rigidity of the plate heat exchanger meets the requirements of higher strength the plate heat exchangers are tested before delivery. In connection with the pressure testing it is desirable that the plastic deformation is as low as possible.

As mentioned above, in order to meet the requirements of higher strength it is a well established technology to use thicker end or strengthening plates, that is the two plates located at the outermost position in the plate package. Such strengthening plates may also be designated as adapter plates or frame and pressure plates. Sheets, washers or thick plane plates may also be provided outside the frame and/or pressure plates. A disadvantage of such additional plates, washers or the like is that the manufacturing becomes more complicated since more components have to be fixed when the plate heat exchanger is produced, for instance when it is brazed.

Another disadvantage of thicker strengthening plates with more material is that the thermal "slowness" increases for this strengthening plates. Due to this higher thermal slowness of the strengthening plates, a reduced thermal fatigue performance of the plate heat exchanger is obtained, in particular in the heat exchanger plates which are provided most adjacent inside the strengthening plates. Since the heat exchanger plates are manufactured of a thinner material, they will more rapidly be adapted to the temperature of the media, which results in an undesired temperature difference between the heat exchanger plates and the strengthening plates, and thus to thermally dependent stresses.

Furthermore, thicker strengthening plates result in the disadvantage that the consumption of material becomes larger and thus the costs for the plate heat exchanger increase.

U.S. Pat. No. 4,987,955 discloses a plate heat exchanger comprising a plurality of plates extending in parallel with a main extension plane. The plates comprise a plurality of heat exchanger plates and at least one strengthening plate. The heat exchanger plates are provided beside each other and form a plate package with first plate interspaces for a first medium and a second plate interspace for a second medium. Each of the heat exchanger plates has four portholes which form ports extending through the plate package. The heat exchanger plates comprise an outermost heat exchanger plate at one side of the plate package and an outermost heat exchanger plate at an opposite side of the plate package. Two of the plate interspaces in the plate package form a respective outermost plate interspace at a respective side of the plate package, which are delimited outwardly by a respective one of the outermost heat exchanger plates. The strengthening plate is provided beside and outside one of the outermost heat exchanger plates.

SUMMARY OF THE INVENTION

The object of the present invention is to decrease or at least alleviate the disadvantages mentioned above and to provide a plate heat exchanger with a high strength. It is further aimed at a plate heat exchanger that can be manufactured at a low cost. In particular, the object of the invention is to achieve a permanently joined plate heat exchanger with improved strength.

This object is achieved by the plate heat exchanger initially defined, which is characterized in that a distance plate is arranged between an adapter plate and a respective one of outermost heat exchanger plates, said distance plate comprising at least two port holes which are concentric with each of the respective port holes of the outermost heat exchanger plates and the adapter plate, and that the port holes of the distance plate are larger than the port holes of the outermost heat exchanger plates and the port hole of the adapter plate, respectively. Due to the distance plate the plate heat exchanger will be able to withstand higher pressures than otherwise would be possible.

In a preferred embodiment of the invention the plates are permanently joined to each other.

In another embodiment of the invention the size and shape of the distance plate are the same as the size and shape of the adapter plate.

In another embodiment of the invention the distance plate is permanently joined to the outermost heat exchanger plates and the adapter plate.

In still another embodiment the distance plate is arranged between a frame plate and the adapter plate and a pressure plate and the adapter plate, respectively.

BRIEF DESCRIPTION OF THE DRAWINGS

The present invention will now be described more closely by means of a description of various embodiments and with reference to the accompanying drawings attached hereto.

DETAILED DESCRIPTION OF DIFFERENT EMBODIMENTS OF THE INVENTION

Figure 1:
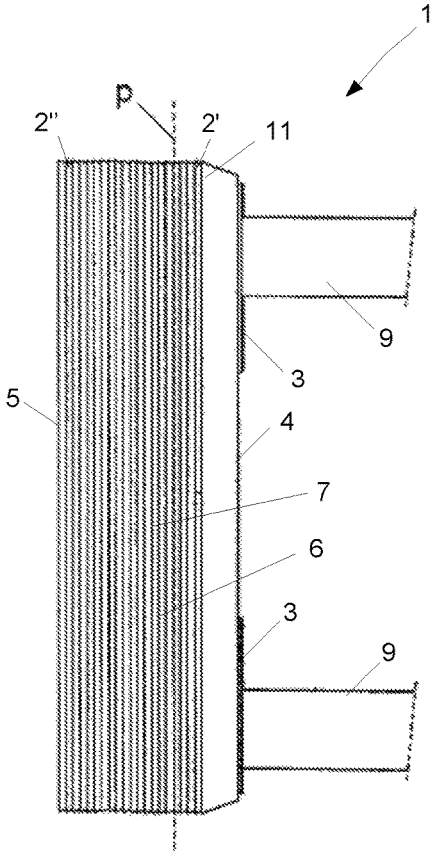
FIG. 1 discloses a side view of a previously known plate heat exchanger.
Figure 2:
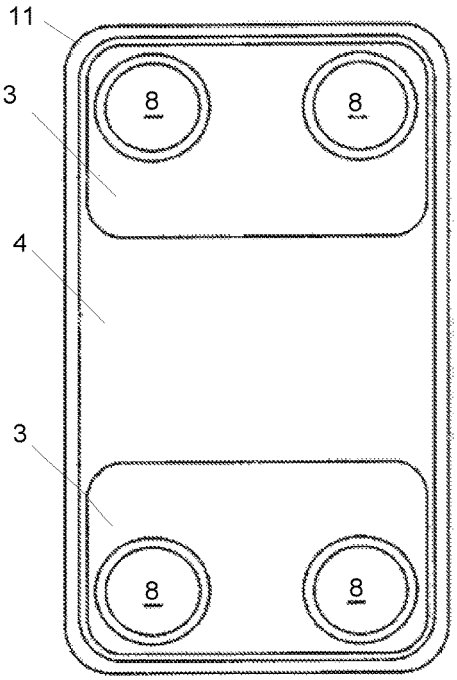
FIG. 2 discloses a front view of the plate heat exchanger in FIG. 1.
Figure 3:
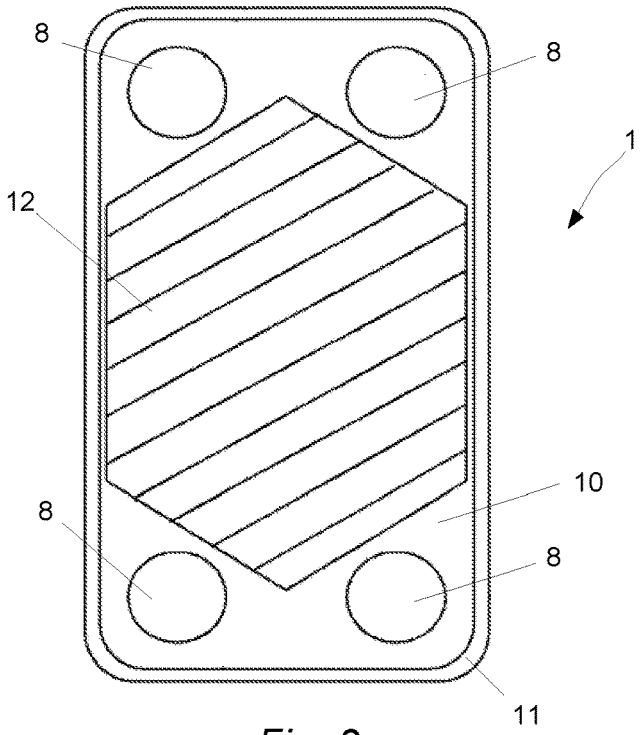
FIG. 3 discloses a front view of a heat exchanger plate of the plate heat exchanger in FIG. 1
Figure 4:
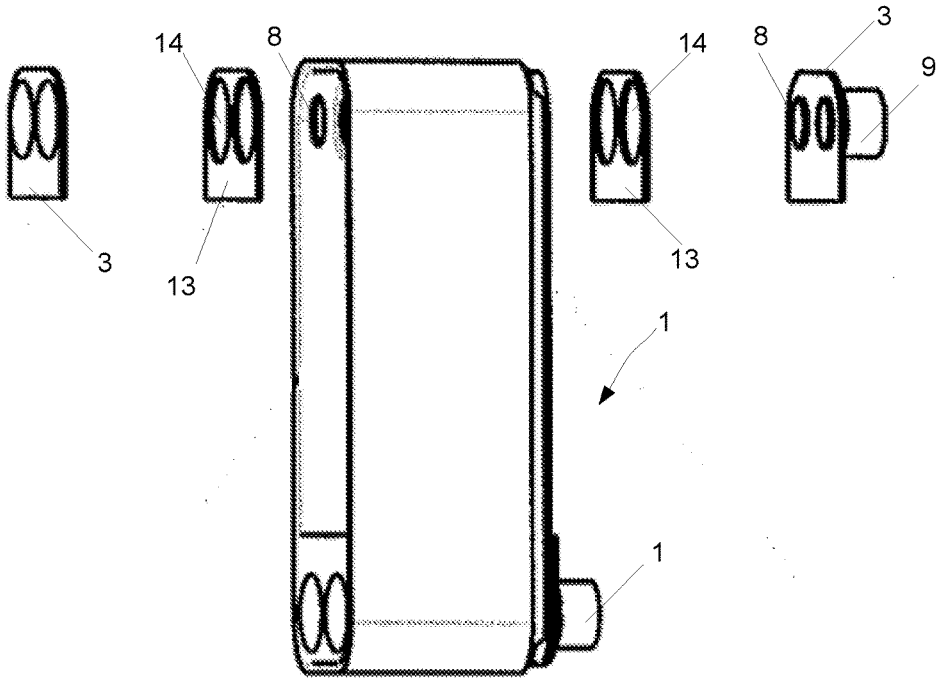
FIG. 4 discloses an exploded view of one embodiment of the heat exchanger according to the present invention FIG. 5 discloses a cross section of one embodiment of the heat exchanger according to the present invention.
Figure 5:
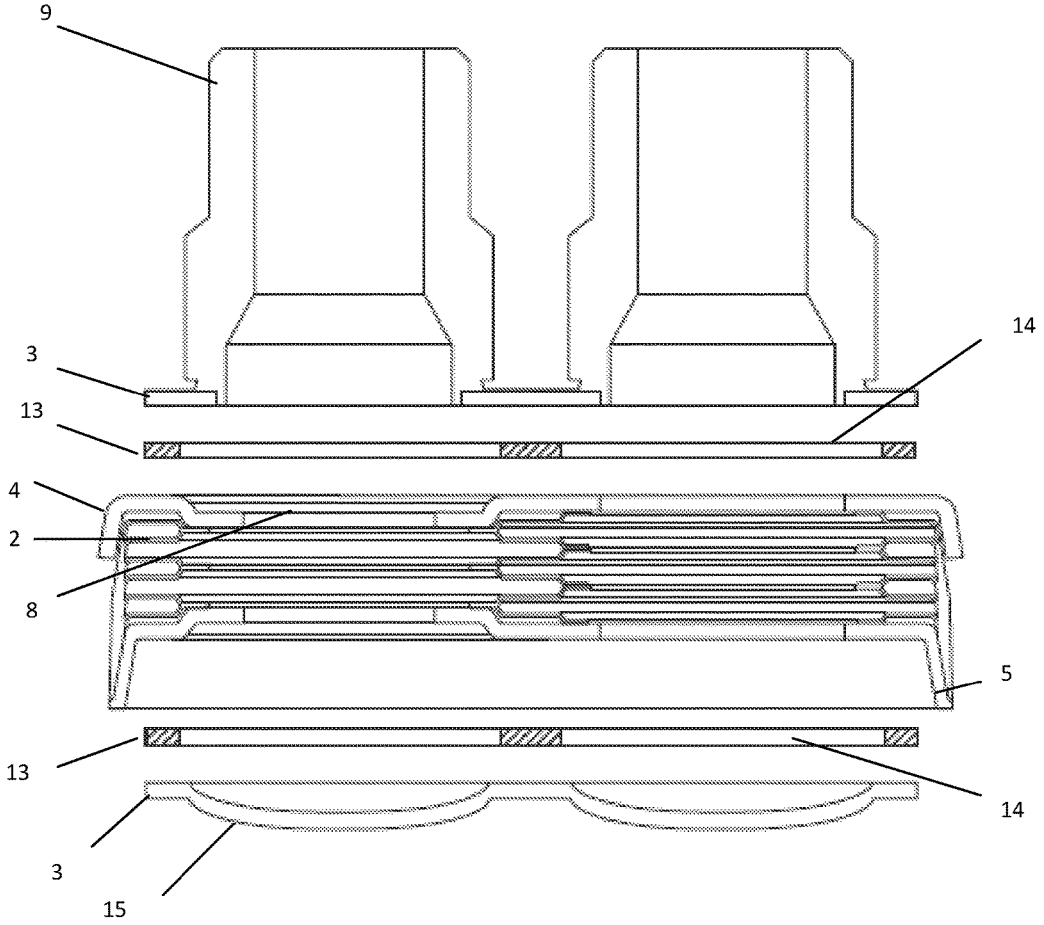

A previously known plate heat exchanger is shown in FIGS. 1-3. The plate heat exchanger 1 comprises a plurality of plates 2, which each extend substantially in parallel with a main extension plane p and forms a plate package. Furthermore, the plate heat exchanger 1 comprises a frame plate 4 and a pressure plate 5, which are provided on a respective side of the plate package. In addition, the plate heat exchanger 1 comprises at least one adapter plate 3. In the shown embodiment, the plate heat exchanger comprises four adapter plates 3. The heat exchanger plates 2 form a plate package with first plate interspaces 6 for a first medium and second interspaces 7 for a second medium. The plate interspaces 6 and 7 are provided in an alternating order in such a way that every second plate interspace is a first plate interspace 6 and the remaining plate interspaces are second plate interspaces 7.

Each heat exchanger plate 2 comprises four port holes 8 which form port channels extending through the plate package and form inlets and outlets for the two media to the first plate interspaces 6 and the second plate interspaces 7, respectively. The inlets and outlets are connected to schematically disclosed inlet and outlet pipes 9 which may be arranged on the adapter plates 3. When no inlet and/or outlet pipes 9 are present the adapter plate 3 is close. Each heat exchanger plate 2 comprises an inner heat exchanger zone 10 and an outer edge zone 11 extending around the heat exchanger zone 10. The outer edge zone 11 comprises or forms a surrounding flange extending outwardly from the extension plane p. Also the frame plate 4 and the pressure plate 5 have such an outer edge zone 11 which comprises or forms a flange extending outwardly from the extension plane p. In the preferred embodiment, each adapter plate 3 has such a size that it is contained within the outer edge zone 11. The adapter plates 3 may also be provided with a strengthening pattern provided in the proximity of two of the ports 8.

Furthermore, each heat exchanger plate 2 has in a manner known per se a press pattern 12, see Fig in the form of at least one corrugation of ridges and valleys on the heat exchanger zone 10. The press pattern 12 which is disclosed in FIG. 3 is merely schematic and one example of such pattern. It is to be noted that the heat exchanger plates 2 may have press patterns of a variety of designs.

The heat exchanger plates 2 comprise an outermost heat exchanger plate 2" at an opposite side of the plate package. Furthermore, the heat exchanger plates 2, 2', 2" form two outermost plate interspaces at a respective side of the plate package. The two outermost plate interspaces are delimited outwardly by the outermost heat exchanger plate 2' and the outermost heat exchanger plate 2", respectively. The adapter plates 3 are provided outside one of the outermost heat exchanger plates 2' and 2", respectively.

In a preferred embodiment of the invention the frame plate 4 is provided immediately outside the outermost heat exchanger plate 2' and the pressure plate 5 is provided immediately outside the outermost heat exchanger plate 2". The frame plate 4 and the pressure plate 5 have in this embodiment no thermal function, i.e. none of the media is conveyed between the outermost heat exchanger plate 2' and the frame plate 4, or between the outermost heat exchanger plate 2" and the pressure plate 5. The frame plate 4 and the pressure plate 5 may thus be substantially plane, i.e. lack the press pattern 12 which is provided on the heat exchanger plates 1.

According to the invention a distance plate 13 having substantially the same outer dimensions as the adapter plate 3, is arranged in a sandwich construction between the frame plate 4 and the adapter plate 3 and/or the pressure plate 5 and the adapter plate 3. The distance plate 13 is provided with port holes 14 which are substantially concentric with the port holes 8 of the frame plate 4 and/or the pressure plate 5 and the port holes 14 of the adapter plate 3. However, the size of the port holes 14 of the distance plate 13 are larger than the size of the port holes 8 of the plates, frame and pressure plates and the adapter plate 3, if provided with port holes. The adapter plate 3 may not be provided with inlet and outlet pipes 9 and in such case the adapter plate outside the pressure plate 5 is closed. In a special case the adapter plate 3 may be provided with bulges 15, i.e. an outwardly convex area with a size and diameter substantially corresponding to the port holes 8 of the plates 2. The purpose of the bulges is to better withstand the pressure exerted by the fluid in the plate interspaces. The diameter of such bulbs preferably corresponds to the diameter and shape of the ports holes 8. Due to the larger size, i.e. diameter of the port holes 14 of the distance plate 13, a plate heat exchanger with improved strength and rigidity may be achieved since the fluid pressure. During operation, a pressure arises in the interior of the plate heat exchanger, which pressure tends to press the plate package outwardly, in particular the outer heat exchanger plates 2, 2', 2". By means of the distance plate 13 provided immediately outside the frame plate 4 and immediately outside the pressure plate 5, such outward bending is prevented.

All the plates, i.e. the adapter plates 3, the frame plate 4, the heat exchanger plates 2, 2', 2" and the pressure plate 5, are permanently connected to each other, preferably through melting of a metallic material, e g brazing, bonding, welding or a combination thereof. Also the inlet and outlet pipes 9 may be brazed to the plates, and more precisely to the adapter plates 3. The plates may also be permanently connected by gluing.

The invention is not limited to the described embodiments but may be varied and modified within the scope of the following claims.

The invention claimed is:

1. A plate heat exchanger comprising a plurality of plates, which each extend in parallel with a main extension plane, where the plurality of plates comprises a plurality of heat exchanger plates an adapter plate, wherein the heat exchanger plates are provided beside each other in a first direction and form a plate package with first plate interspaces for a first medium and second plate interspaces for a second medium, the first plate interspaces alternating with the second plate interspaces in the first direction, the plate package being delimited by a first outermost side and an opposite second outermost side spaced apart in the first direction, wherein each of the heat exchanger plates has four port holes which form ports extending through the plate package, each of the heat exchanger plates including an inner heat exchanger zone lying in a plane and an outer edge zone forming a flange that surrounds the inner heat exchanger zone and that projects outwardly from the plane of the inner heat exchanger zone;

wherein the heat exchanger plates comprise a first outermost heat exchanger plate at the first outermost side of the plate package and an outermost heat exchanger plate at the second outermost side of the plate package such that the first outermost heat exchanger plate defines the first outermost side of the plate package and the second outermost heat exchanger plate defines the second outermost side of the plate package, wherein a first one of said plate interspaces in the plate package forms a first outermost plate interspace at the first outermost side of the plate package which is delimited outwardly in the first direction by the first outermost heat exchanger plate, and a second one of said plate interspaces in the plate package forms a second outermost plate interspace at the second outermost side of the plate package which is delimited outwardly in the first direction by the second outermost heat exchanger plate, wherein the adapter plate is provided outside, in the first direction, the first outermost heat exchanger plate so that the adapter plate is positioned outside the first outermost heat exchanger plate in the first direction, the adapter plate including a plurality of port holes, a distance plate arranged a distance plate arranged between said adapter plate and the first outermost heat exchanger plate, the distance plate comprising a flat plate lacking a flange, a frame plate positioned a frame plate positioned between the first outermost heat exchanger plate and the distance plate, the frame plate including an inner zone lying in a plane and an outer edge zone forming a flange that surrounds the inner zone and that projects outwardly from the plane of the inner zone, and said distance plate comprising two port holes, which are each concentric with one of the respective port holes of the first outermost heat exchanger plate and one of the port holes of the adapter plate, and the port holes of the distance plate being larger than the port holes of the first outermost heat exchanger plate and the port holes of the adapter plate, respectively.

2. A plate heat exchanger according to claim 1, wherein the plurality of plates are permanently joined to each other.

3. A plate heat exchanger according to claim 1, wherein the distance plate is permanently joined to the first outermost heat exchanger plate and the adapter plate.

4. A plate heat exchanger according to claim 1, wherein the adapter plate defines a first adapter plate, and the distance plate defines a first distance plate, the plurality of plates further comprising a second adaptor plate and a second distance plate, the first distance plate being arranged between the frame plate and the first adapter plate, and the second distance plate being arranged between a pressure plate and the second adapter plate.

5. A plate heat exchanger according to claim 1, wherein the adapter plate is provided with at least one of an inlet pipe and an outlet pipe.

6. A plate heat exchanger comprising:

a plurality of heat exchanger plates, first and second adapter plates, a frame plate, and a pressure plate;

the heat exchanger plates, first and second adapter plates, the frame plate, and the pressure plate each extending parallel with a main extension plane;

the heat exchanger plates being arranged beside each other, in the first direction, to form a plate package with alternating first plate interspaces for a first medium and second plate interspaces for a second medium, the first plate interspaces alternating with the second plate interspaces in the first direction, the plate package being delimited by a first outermost side and an opposite second outermost side spaced apart in the first direction;

each of the heat exchanger plates including four port holes which form ports extending through the plate package;

each of the heat exchanger plates including an inner heat exchanger zone lying in a plane and an outer edge zone forming a flange that surrounds the inner heat exchanger zone and that projects outwardly from the plane of the inner heat exchanger zone;

the frame plate and the pressure plate each including an inner zone lying in a plane and an outer edge zone forming a flange that surrounds the inner zone and that projects outwardly from the plane of the inner zone;

the heat exchanger plates comprising a first outermost heat exchanger plate at the first outermost side of the plate package and a second outermost heat exchanger plate at the second outermost side of the plate package such that the first outermost heat exchanger plate defines the first outermost side of the plate package and the second outermost heat exchanger plate defines the second outermost side of the plate package;

a first one of the plate interspaces in the plate package forming a first outermost plate interspace at the first outermost of the plate package which is delimited outwardly in the first direction by the first outermost heat exchanger plate and a second one of the plate interspaces in the plate package forming a second outermost plate interspace at the second outermost side of the plate package which is delimited outwardly in the first direction by the second outermost heat exchanger plate;

the frame plate being arranged outside, in the first direction, the first outermost heat exchanger plate;

the pressure plate being arranged outside, in the first direction, the second outermost heat exchanger plate;

the first adapter plate being provided outside, in the first direction, of the frame plate, the first adaptor plate comprising a plurality of port holes;

the second adapter plate being provided outside, in the first direction, of the pressure plate, the second adaptor plate comprising a plurality of two port holes;

a first distance plate arranged between the first adapter plate and the frame plate, and a second distance plate arranged between the second adapter plate and the pressure plate;

the first distance plate comprising a plurality of port holes each concentric with respective ones of the port holes of the first outermost heat exchanger plate and respective ones of the port holes of the first adapter plate, the port holes of the first distance plate being larger than the respective port holes of the first outermost heat exchanger plate and larger than the respective port holes of the first adapter plate;

the first distance plate comprising a flat plate lacking a flange;

the second distance plate comprising a flat plate lacking a flange; and the second distance plate comprising a plurality of two port holes each concentric with respective ones of the port holes of the second outermost heat exchanger plate and respective ones of the port holes of the second adapter plate, the port holes of the second distance plate being larger than the respective port holes of the second outermost heat exchanger plate and larger than the respective port holes of the second adapter plate.

7. A plate heat exchanger according to claim 6, wherein the heat exchanger plates, the frame plate, the pressure plate, the first adapter plate and the second adapter plate are permanently joined to each other.

8. A plate heat exchanger according to claim 6, wherein the first distance plate is permanently joined to the first adapter plate, and the second distance plate is permanently joined to the second adapter plate.

9. A plate heat exchanger according to claim 6, wherein the first adapter plate is provided with at least one of an inlet pipe and an outlet pipe.

10. A plate heat exchanger according to claim 6, wherein the first adapter plate is provided with two spaced apart pipes.

* * * * *